US010871319B2

(12) United States Patent
Witt et al.

(10) Patent No.: US 10,871,319 B2
(45) Date of Patent: Dec. 22, 2020

(54) ICE MACHINE

(75) Inventors: Mark Witt, Chicago, IL (US); Margaret Lowan Benezra, Rolling Meadows, IL (US); Craig Anderson, Troy, MI (US); Martin Rathgeber, Chicago, IL (US); King Ya Moy, Tinley Park, IL (US); Natan Pheil, Chicago, IL (US); Daniel A. Peterson, Chicago, IL (US); David Chesley, Duxbury, MA (US)

(73) Assignee: Aspen Ice, LLC, Chicago, IL (US)

( * ) Notice: Subject to any disclaimer, the term of this patent is extended or adjusted under 35 U.S.C. 154(b) by 354 days.

(21) Appl. No.: 13/573,129

(22) Filed: Aug. 23, 2012

(65) Prior Publication Data

US 2014/0053949 A1 Feb. 27, 2014

(51) Int. Cl.

| | |
|---|---|
| ***F25C 5/20*** | (2018.01) |
| ***B65B 1/04*** | (2006.01) |
| ***B65B 37/10*** | (2006.01) |
| ***B65B 9/13*** | (2006.01) |
| ***B65B 1/12*** | (2006.01) |
| ***B65B 1/32*** | (2006.01) |
| ***B65B 43/36*** | (2006.01) |
| ***B65B 43/26*** | (2006.01) |

(52) U.S. Cl.

CPC ..... *F25C 5/20* (2018.01); *B65B 1/04* (2013.01); *B65B 1/12* (2013.01); *B65B 1/32* (2013.01); *B65B 9/13* (2013.01); *B65B 37/10* (2013.01); *B65B 43/267* (2013.01); *B65B 43/36* (2013.01); *F25C 2500/08* (2013.01); *F25D 2331/801* (2013.01)

(58) Field of Classification Search

CPC ..... F25C 5/16; F25C 5/18; B65B 1/32; B65B 3/28; B65B 51/146; B65B 5/067; B65B 5/061; B65B 5/06; A47B 88/0085

USPC ..... 141/10, 82, 83, 98, 313–317; 222/146.6, 222/252, 254; 53/469

See application file for complete search history.

(56) References Cited

U.S. PATENT DOCUMENTS 2,879,811 A * 3/1959 Parraga ..... 141/82
3,151,668 A * 10/1964 Zimmermann ..... G07F 11/68 206/283
4,368,608 A * 1/1983 Ray ..... 53/440
4,856,682 A * 8/1989 Miller et al. ..... 222/238
(Continued)

OTHER PUBLICATIONS

Twin Eagles Paper Towel Drawer, published Jun. 26, 2009, www.twineaglesinc.com/products/Paper-Towel-Drawer.shtml, accessed Nov. 19, 2015.*

*Primary Examiner* — Andrew D StClair
(74) *Attorney, Agent, or Firm* — DLA Piper LLP (US)

(57) ABSTRACT

An ice bagger is provided. The ice bagger includes an ice hopper into which ice is disposed from an ice manufacturer. The ice hopper further includes an ice agitator and defines an ice trough there beneath. An ice auger, housed inside the ice trough, transports ice to an ice delivery chute. A hatch is positioned beneath the ice delivery chute, upon which the bag rests while filling. A scale is positioned on the hatch. The scale weighs the ice being deposited into the bag. When the bag is full, the bag is sealed by a sealer. When the bag is sealed, the hatch opens and the bag of ice is deposited in an bag depository. This Abstract is submitted with the understanding that it will not be used to interpret or limit the scope or meaning of the claims.

10 Claims, 9 Drawing Sheets

(56) References Cited

U.S. PATENT DOCUMENTS

| | | | | | |
|---|---|---|---|---|---|
| 5,109,651 | A * | 5/1992 | Stuart | F25C 5/20 | 53/502 |
| 5,440,863 | A * | 8/1995 | Toya et al. | 53/571 | |
| 5,458,851 | A * | 10/1995 | Schroeder et al. | 422/28 | |
| 5,473,865 | A * | 12/1995 | Tanaka et al. | 53/502 | |
| 5,822,955 | A * | 10/1998 | Woosley et al. | 53/570 | |
| 6,047,863 | A * | 4/2000 | Kanzler et al. | 222/238 | |
| 6,474,048 | B1 * | 11/2002 | Metzger et al. | 53/493 | |
| 6,827,529 | B1 * | 12/2004 | Berge et al. | 406/28 | |
| 7,281,694 | B2 * | 10/2007 | Allen | A47B 88/044 | 211/183 |
| 7,426,812 | B2 * | 9/2008 | Metzger | 53/459 | |
| 2004/0084106 | A1 * | 5/2004 | James | 141/313 | |
| 2007/0267086 | A1 * | 11/2007 | Dunn | 141/2 | |

* cited by examiner

ICE MACHINE

FIELD OF THE INVENTION

The present invention relates to automated ice baggers and methods for placing ice into bags.

BACKGROUND OF THE INVENTION

Ice is used for many purposes, including cooling of food and beverages. Individual consumers and businesses that require ice, such as restaurants, typically purchase ice at a retail establishment. Alternatively, ice may also be delivered directly to the consumer or business. Ice is typically sold and/or delivered in sealed bags. The production and bagging of ice occurs at a remote location. Bags of ice are then transported from the remote location to a retail establishment for sale. The bags are stored in a freezer until retrieved upon purchase.

The separation of the point of production of ice from the point of sale of ice has many disadvantages. Transportation of ice from a remote location to a retail establishment requires manual labor and money for fuel and equipment cost, which increases the price of a bag of ice. This is exacerbated by the requirement that the delivery vehicle must provide for freezing transportation conditions. Even with freezer delivery vehicles, ice is exposed to ambient temperatures when the ice is unloaded into the establishment, causing ice to melt. Bridging of ice upon refreezing occurs when the bags of ice are put back into a freezer at the retail establishment. Bridging occurs when pieces of ice located adjacent to each other stick together to form a wall, cluster, etc. Bridging renders the ice in the bag unusable, or requires the consumer to break apart the ice before the ice can be used. Ice inventory shortages can occur, especially around holidays or other peak times when the demand for ice is high, such as during hot weather, because ice may not be able to be readily delivered to the retail establishment from the remote location.

Various devices and methods have been suggested to automate the production of bags of ice on-site, combining ice making and bagging assemblies into one unit. One challenge in designing such on-site ice production is accurately metering the amount of ice to be deposited in the bag. For example, some devices use a drum for receiving a predetermined amount of ice from an icemaker or ice holding bin, and transferring the ice to a bag or a bagger. Other devices use boxes or drawers in place of drums, to receive and measure ice, and to transfer ice to a bagger.

Nevertheless, such devices experience a number of drawbacks. One of the drawbacks is the inability of these devices to prevent ice from bridging in the drum, box or drawer. Bridging of ice prevents the drum, box or drawer from being sufficiently filled or emptied with ice, causing the bags of ice produced to be under filled. Further, bridging of ice may result in larger clusters of ice rupturing a bag upon bagging. When a bag ruptures, ice and portions of the bag may spill within the device, requiring that the device be shut down for clean up and maintenance Still further, clusters of bridged ice may cause bags to develop small holes without rupturing the bag, resulting in leakage of water during transfer of the bag after purchase, when ice can partially melt.

In attempting to address these issues, some devices include vibrating means to agitate the ice to prevent the ice from bridging. Nevertheless, these devices also experience a number of drawbacks. One such drawback is that vibrations are unable to separate ice that has already bridged together.

Moreover, vibrations exert high levels of stress on the device; thus, vibrations increase the wear and tear, cause breakdowns, and increase the costs of operating and maintaining of these devices.

Another drawback of such on-site ice production is the inability to provide bags of different predetermined sizes. The size of the bag of ice that can be produced by these devices is typically limited by the size of the drum, box or drawer. These devices are typically not capable of metering differing amounts of ice to be deposited in a bag.

Thus, what would be desirable would be efficiently providing accurate, on-site ice production with minimal maintenance. It would be desirable for on-site ice production to prevent ice from bridging in the ice-holding bin. It would be further desirable for on-site ice production to prevent ice from bridging during delivery of ice to the bagger. It would be further desirable for on-site ice production to monitor the level of ice in the ice-holding bin to ensure that the ice-holding bin is not overfilled or under filled with ice. It would be further desirable for on-site ice production to produce bags of ice of various sizes. It would be further desirable for on-site ice production to determine that the amount of ice deposited in a bag corresponds to the amount of ice requested, to prevent bags from being under filled or overfilled with ice.

SUMMARY OF THE INVENTION

An ice bagger in accordance with the principles of the present invention efficiently provides accurate on-site ice production with minimal maintenance. An ice bagger in accordance with the principles of the present invention helps prevent ice from bridging together in the ice-holding bin, such as a hopper. An ice bagger in accordance with the principles of the present invention helps prevent ice from bridging together during delivery of ice from the hopper to the bagger. An ice bagger in accordance with the present invention monitors the level of ice in the hopper, to prevent the hopper from being under filled or overfilled with ice. An ice bagger of the present invention is capable of delivering bags of ice of various sizes. An ice bagger in accordance with the present invention is further capable of determining that the amount of ice deposited in a bag corresponds to the amount of ice desired in a bag.

In accordance with the principles of the present invention, an ice bagger is provided. The ice bagger includes an ice hopper into which ice is disposed from an ice manufacturer. The ice hopper further includes an ice agitator. The ice hopper defines an ice trough positioned beneath the ice hopper. An ice auger is housed inside the ice trough. The ice auger transports ice to an ice delivery chute. A hatch is positioned beneath the ice delivery chute, upon which the bag rests while filling. The ice delivery chute and the hatch define a bag filling area such that, when bags are present in the bag filling area, the bags are positioned to be filled. A scale is positioned on the hatch. The scale weighs the ice being deposited into the bag. When the bag is full, a sealer seals the bag. When the bag is sealed, the hatch opens and the bag of ice is deposited in a bag depository.

This Summary introduces concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description refers to the following accompanying drawings.

DETAILED DESCRIPTION OF THE PREFERRED EMBODIMENTS

Figure 1:
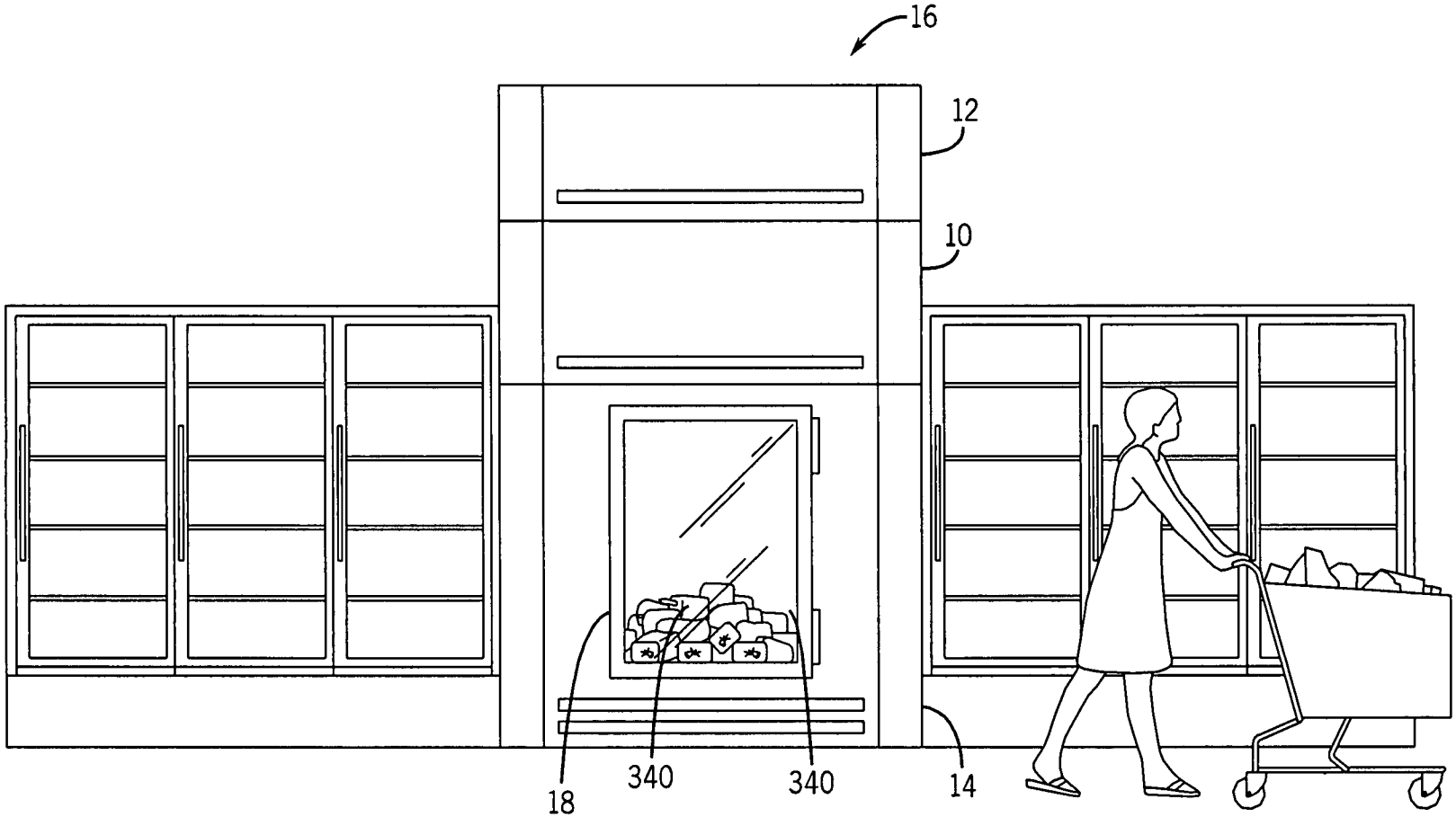
FIG. 1 is a front perspective view of an example ice-delivery device containing an example ice bagger in accordance with the principles of the present invention.

In accordance with the principles of the present invention, an ice bagger is provided. The ice bagger includes an ice hopper into which ice from an ice manufacturer is disposed. The ice hopper is generally funnel shaped to assist in the downward movement of the ice. The lower periphery of the ice hopper defines an aperture through which ice can pass. The ice hopper includes at least one sensor for detecting the level of ice. When the level of ice reaches a predetermined level in the ice hopper, the sensor detects the lack of ice, and a signal is transmitted to the ice manufacturer to deliver more ice.

The ice hopper further includes an ice agitator. The ice agitator comprises mechanical means to break up ice. In one embodiment, the ice agitator comprises a bar having a plurality of fingers positioned generally perpendicular to the longitudinal axis of the bar. The ice agitator stirs and churns the ice disposed in the ice hopper to help prevent ice from bridging together, to help break apart bridged ice, and to assist ice in travelling down the ice hopper.

An ice trough is positioned beneath the ice hopper aperture. A generally horizontally positioned ice auger is housed within the ice trough. At one end of the ice trough, a downwardly facing aperture is defined. An ice delivery chute extends from the trough aperture. Ice is deposited in a generally downward direction from the ice hopper through the ice hopper aperture to the ice trough. The ice auger transports ice in a substantially horizontal direction from beneath the ice hopper through the trough aperture to the ice delivery chute.

A bag deliverer delivers bags to a position under the ice delivery chute. The bag deliverer includes a bag holder adopted to receive and store a roll of bags. In one embodiment, the roll of bags comprises a plurality of preformed connected bags. The connected bags have a pre-sealed bottom and an unsealed top. The bag deliverer includes a plurality of bag rollers adapted to transport the then connected bags from the roll of bags to the position under the ice delivery chute. A bag tension bar provides tension to the roll of bags to help prevent the roll of bags from displacing off the bag track or from becoming loose and bunching. At least one sensor can be used to position the bag under the chute to receive ice. After receiving the ice, an individual bag is separated from the roll of bags.

A hatch is positioned beneath the ice delivery chute, upon which the bag rests while filling. The ice delivery chute and the hatch define a bag filling area such that, when bags are present in the bag filling area, the bags can be filled. A blower is positioned to open the mouth of a bag prior to ice being deposited in the bag. A scale is positioned on the hatch. The scale weighs the ice deposited into the bag. When the weight of the ice disposed into the bag reaches a predetermined level, the ice auger stops transporting ice. When the bag is full, the bag is sealed by a sealer. The sealer includes a heat seal bar and a heat seal element. In another embodiment, the roll of bags does not have a pre-sealed bottom, and the sealer can be used to form the sealed bottom prior to being filled with ice. After depositing the ice in the bag, when the top of the bag is sealed by the sealer, the hatch opens and the bag of ice is deposited in a bag depository. The ice bagger along with the ice manufacturer and bag deliverer can be housed inside an insulated enclosure cooled by a cooling unit to keep the temperature of the insulated enclosure at a desired level.

Thus, in one aspect the ice bagger generally prevents ice from bridging together in the ice hopper and during delivery of ice to the bagger. In another aspect, the ice bagger monitors the level of ice in the hopper to prevent the hopper from overfilling or under filling with ice. In another aspect, the ice bagger is capable of producing bags of ice of various sizes. In another aspect, the ice bagger is capable of ensuring that the amount of ice deposited in a bag corresponds to the amount of ice requested to be placed in the bag.

As detailed below, the process is preferably automated and/or computer controlled. Because the process is automated, the size of the bag can be easily changed. Various sizes of bags containing ice can be produced; preferably, 5, 10, 20 pounds or, indeed, any pound or liter sized bags, by specifying the desired weight. In the embodiment where the roll of bags does not have a pre-sealed bottom, the sealer can be used to form the sealed bottom of an appropriately sized bag. Ice will be delivered to the bag until the scale records the desired weight, upon which a signal will be sent to the auger to stop delivering ice, and the bag will be sealed and delivered to the bag depository. In another embodiment, different size bags with the pre-sealed bottom can be provided depending on the amount of ice desired. Because the process is automated, the processing parameters can be automatically adjusted to account for the size of the bag. For example, if a smaller bag is used parameters for sealing and the weight can be automatically adjusted.

By making, packaging, and storing the ice in accordance with the present invention, transportation of ice from a remote location to the retail establishment is avoided. This reduces labor, equipment, and fuel cost, which decreases the price of a bag of ice. In addition, ice is no longer exposed to ambient temperatures during delivery, reducing melting and bridging of ice. Ice inventory shortages can be addressed in real time, because more inventory can be generated in real time in response to demand.

In more detail, referring now to FIGS. 1-8 an example ice bagger 10 in accordance with the principles of the present invention is seen. Referring first to FIG. 1, the ice bagger 10 is coupled with an ice manufacturer 12 and a bag depository 14, which can be packaged within an insulated enclosure 16. In FIG. 1, the insulated enclosure 16 is seen installed in a grocery or convenience store isle. The insulated enclosure 16 is cooled by a cooling unit (not seen), which also can be included in the insulated enclosure 16. The cooling unit should be sufficient to bring and maintain the interior of the ice bagger 10 at around or below 32° Fahrenheit (0° Celsius) to minimize or avoid melting of the ice.

It is commercially advantageous to minimize the footprint of the insulated enclosure 16 without minimizing the efficiency of the ice bagger 10. Thus, in one embodiment the ice manufacturer 12 can be stacked on the ice bagger 10, which in tune can be stacked on the bag depository 14 within the cooled insulated enclosure 16.

The ice manufacturer 12 may be of any conventional type, in that the particular ice manufacturer does not form an essential part of the present invention. Generally, the ice manufacturer 12 will, however, be suitable for making ice in the form of ice cubes, pieces, particles, shavings or nuggets. The present invention can receive ice from multiple icemakers in order to maximize the total volume of ice production. In addition, different forms of ice cube configurations can be accommodated depending on ice maker style and type Also, the bag depository 14 may be of any conventional type, in that the particular bag depository does not form an essential part of the present invention. In one embodiment, the bag depository 14 can be accessible by consumers by opening an insulated door 18. The door can include a sensor that determines when the door is open and ice is being accessed to prevent bags of ice from dropping and making contact with or harming customers or other operators using or near the device. The level of bags in the cooler can be monitored by a sensor so as not to make and deliver bags of ice when the cooler is full.

Figure 2:
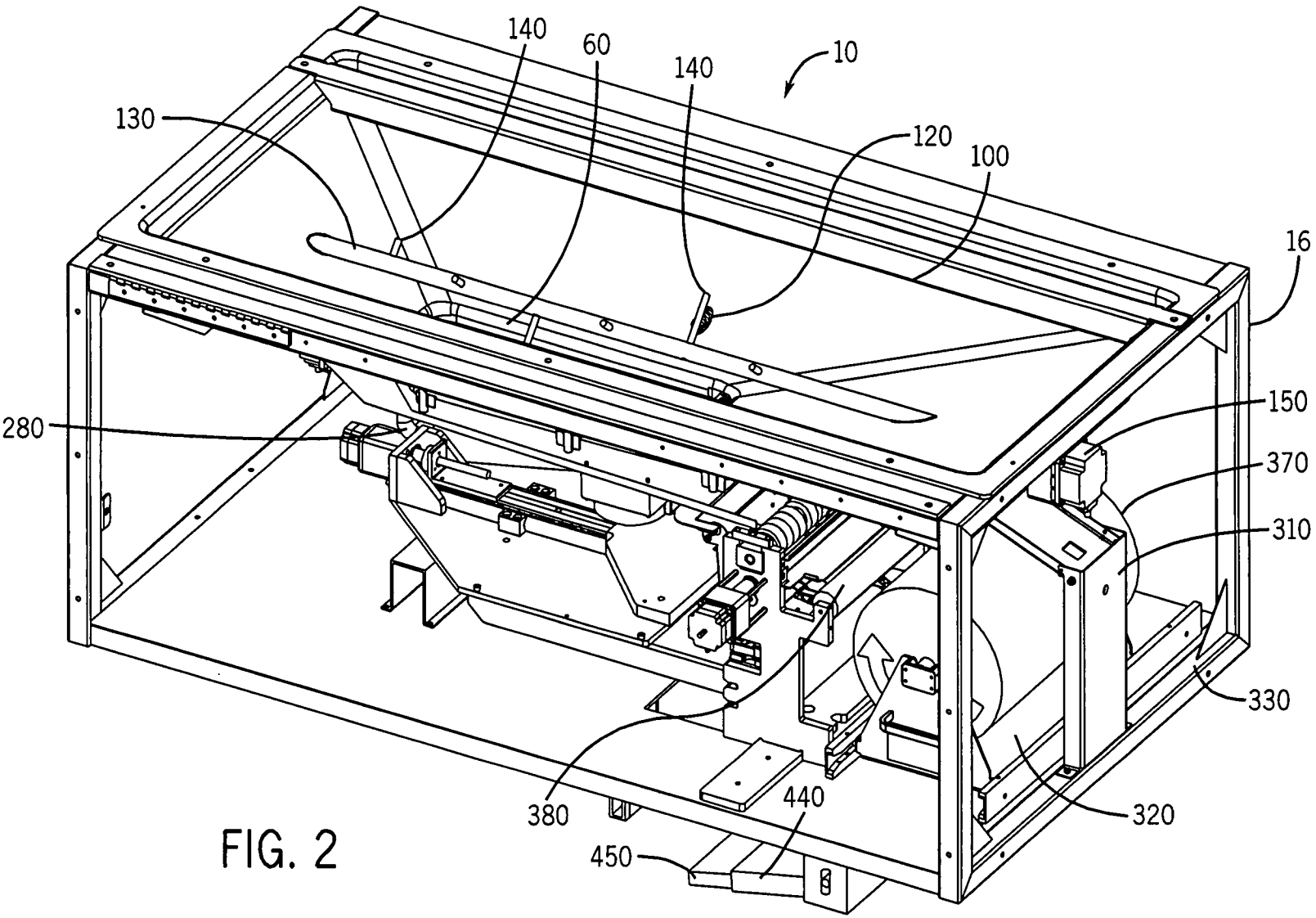
FIG. 2 is a perspective view of the ice bagger of FIG. 1.

FIG. 2 is a perspective view of the ice bagger 10 of FIG. 1, with part of the wall of the insulated enclosure 16 removed. The ice bagger 10 includes an ice hopper 100 configured and dimensioned to receive and house ice produced by the ice manufacturer 12. The dimensions of the hopper 100 may vary depending on the desired amount of ice to be held in the ice hopper 100 and the desired output of the ice bagger 10.

The ice hopper 100 has an open top surface to allow ice to be fed into the ice hopper 100 from the ice manufacturer 12. Generally, ice will be fed from the ice manufacturer 12 to the ice hopper 100 in a substantially vertical direction. The ice hopper is generally funnel shaped to assist in the downward movement of the ice. At the bottom, the ice hopper defines an aperture 60.

Figure 3:
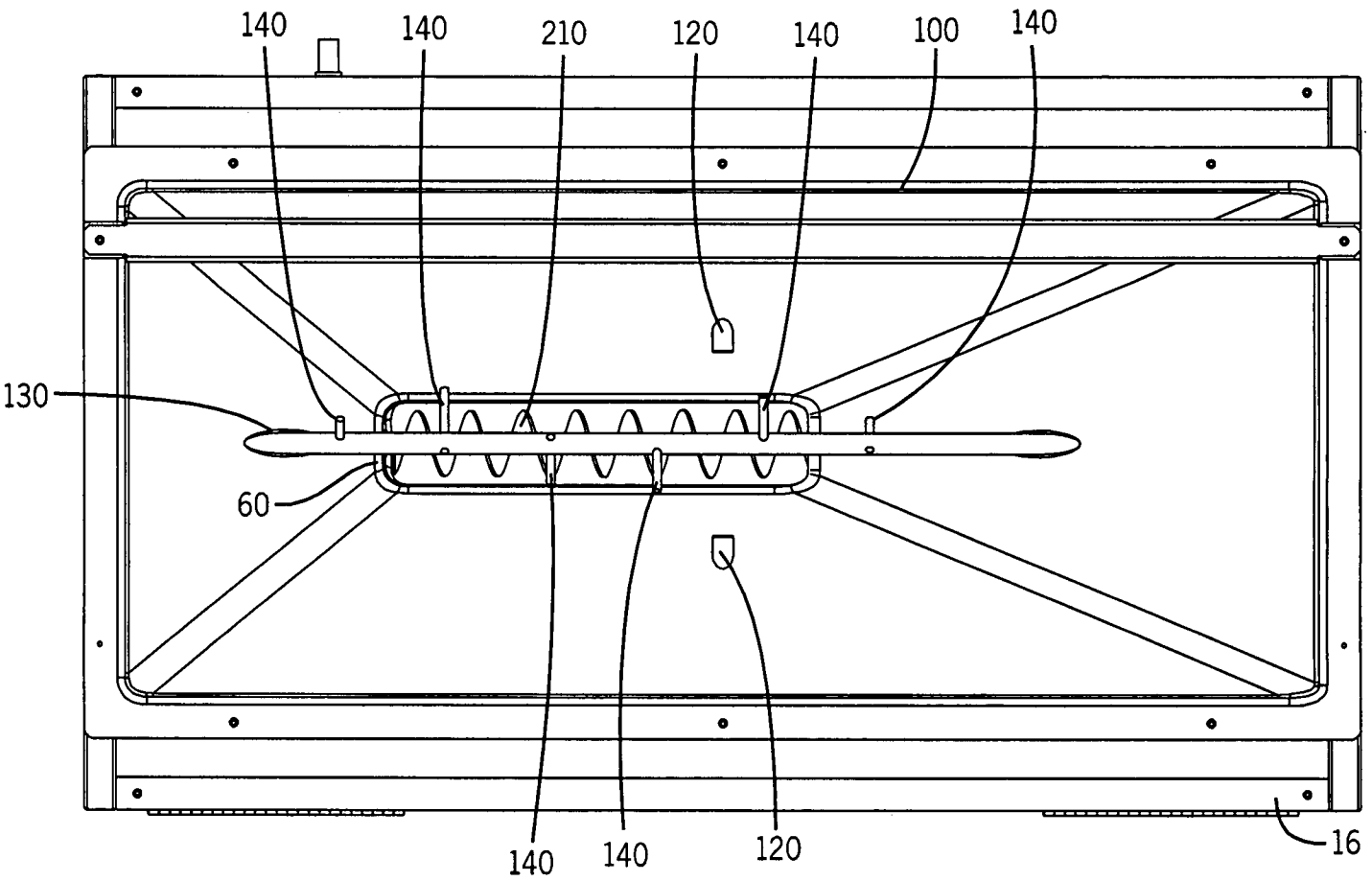
FIG. 3 is a top view of the ice bagger of FIG. 1.

Referring now to FIG. 3, a top view of the ice bagger 10 of FIG. 1 is seen. The ice hopper 100 includes at least one sensor 120 such as reflective or capacitance sensors for detecting the level of ice in the ice hopper 100. Alternatively, a mechanical switch type sensor or other means of determining if ice is present can be utilized. When the level of ice falls below a predetermined level in the ice hopper 100, the sensor 120 detects the lack of ice and a signal is transmitted by the sensor 120 to the ice manufacturer 12 to manufacture more ice. The sensor 120 may be placed in various locations in the ice hopper 100, depending on the size of the ice hopper 100 and the desired output of the ice bagger 10.

Ice in the ice hopper 100 may have the tendency to bridge together if left unagitated for periods of time. The ice hopper 100 further includes an ice agitator 130. The ice agitator 130 stirs and churns the ice disposed in the ice hopper 100 to prevent ice from bridging together and/or to break apart ice that have already frozen together. The ice agitator 130 also assists ice in traveling down the ice hopper 100.

The ice agitator 130 includes a plurality of fingers 140. The fingers 140 can be positioned generally perpendicular to the longitudinal axis of the ice agitator 130. The number and size of the fingers 140 is sufficient: to help prevent ice in the ice hopper 100 from bridging together; to help break apart bridged ice in the ice hopper 100; and to assist ice in travelling down the ice hopper 100. The ice agitator 130 may be generally horizontally positioned approximately in the middle of the ice hopper 100, and the ice agitator 130 traverses substantially the length of the ice hopper 100.

Figure 4:
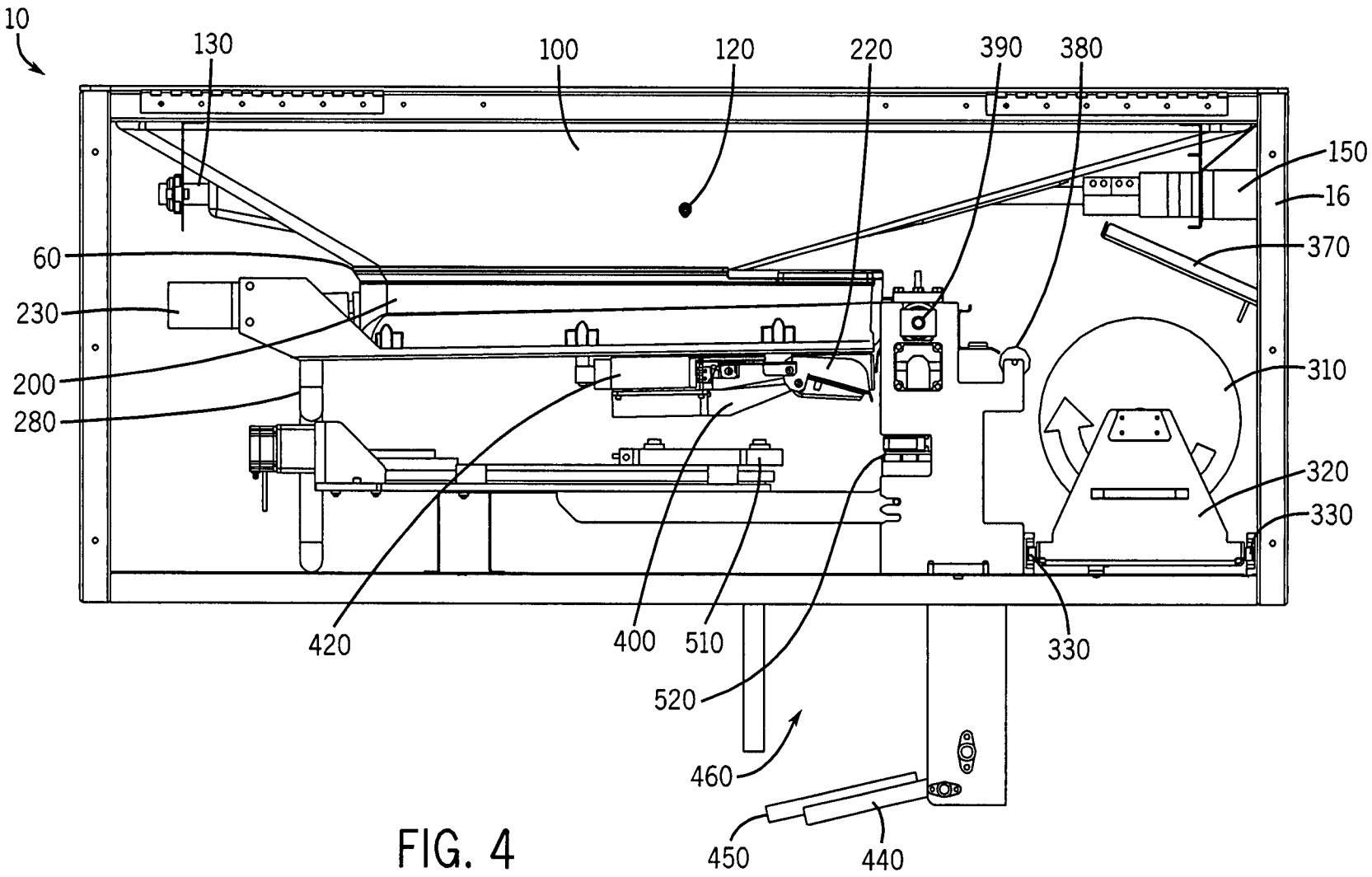
FIG. 4 is a side elevational view of the ice bagger of FIG. 1.

Referring now to FIG. 4, a side elevational view of the ice bagger 10 of FIG. 1 is seen. The ice agitator 130 is driven by an agitator motor 150 of sufficient power to drive the ice agitator 130 and cause the ice agitator 130 to effectively stir and chum ice in the ice hopper 100. The agitator motor 150 is operatively associated with the agitator bar 130. The agitator motor 150 can be located on the exterior of the ice hopper 100. The agitator motor 150 may be mounted to a wall of the insulated enclosure 16.

When a request to make additional inventory of bags of ice is made, the agitator motor 150 drives the ice agitator 130 to stir and churn the ice in the ice hopper 100. The ice agitator motor also may be programmed 150 to drive the ice agitator 130 to stir or churn ice in the ice hopper 100 at predetermined time intervals in order to help prevent ice from bridging during times when inventory is not being made, such as when the establishment is closed.

The ice bagger 10 further comprises an ice trough 200 operably positioned beneath the ice hopper aperture 60. The ice trough 200 receives ice from the ice hopper 100. Ice is deposited in a generally downward direction from the ice hopper 100 through the ice hopper aperture 60 to the ice trough 200. The ice trough 200 is positioned substantially horizontally with respect to the ground.

Figure 5:
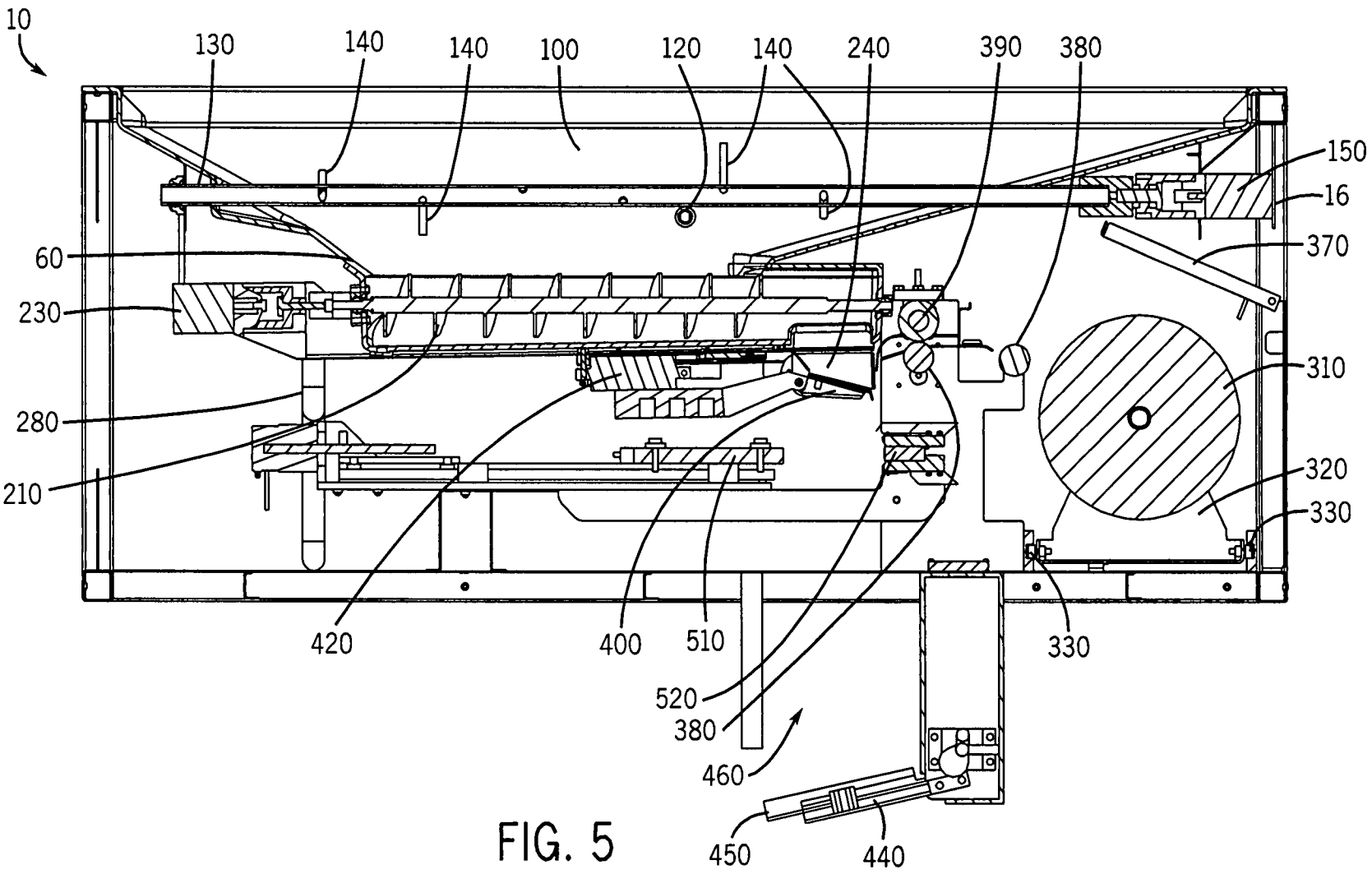
FIG. 5 also is a side elevational view of the ice bagger of FIG. 1, with part of the structure removed for ease of viewing.
Figure 6:
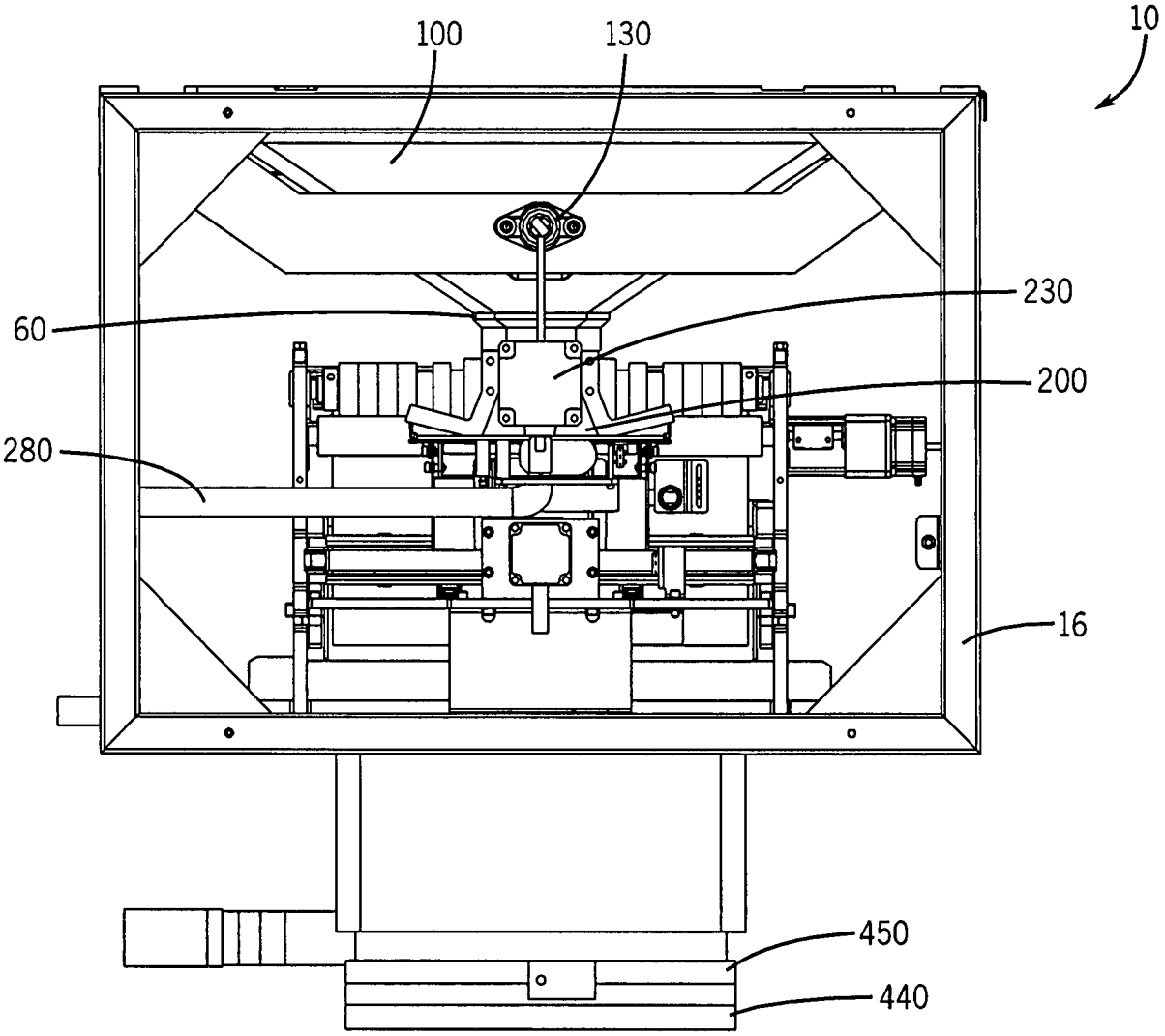
FIG. 6 is an end view of the ice bagger of FIG. 1.

FIG. 5 is a side elevational view of the ice bagger 10 of FIG. 1, with part of the ice trough 200 removed. The bottom surface 270 of the ice trough 200 is slightly inclined towards a downwardly facing a trough aperture 240 defined at an end of the ice trough 200. As a result of the slight decline away from the trough aperture 240, any water that has accumulated in the ice trough 200 drains away from the trough aperture 240. The ice bagger 10 is operatively associated with a drain 280 to channel melt runoff away from the ice. The drain 280 is also seen in FIG. 6, an end view of the ice bagger 10 of FIG. 1.

Referring back to FIG. 5, an ice auger 210 is housed inside the ice trough 200. The ice auger 210 is oriented substantially horizontally in approximately the middle of the ice trough 200. The ice auger traverses substantially through the length of the ice trough 200 from beneath the ice hopper 100 to the trough aperture 240. The ice auger 210 transports ice in a substantially horizontal direction from beneath the ice hopper 100 to the trough aperture 240. During the time ice is transported from beneath the ice hopper 100 through the trough aperture 240, the ice auger 210 helps prevent the bridging of ice and/or breaks apart ice that has frozen together.

The ice auger 210 is driven by an auger motor 230 of power sufficient to cause the ice auger to transport ice from beneath the ice hopper 100 to the trough aperture 240. The auger motor 230 is operatively associated with the ice auger 210. The auger motor 230 may be located on the exterior of the ice trough 200. The auger motor 230 may be mounted to a wall of the insulated enclosure 16.

When a request to make additional inventory of bags of ice is made, the ice auger 210 is activated. Upon activation, the ice auger 210 transports ice in a substantially horizontal direction from beneath the ice hopper 100 through the ice trough 200 to the trough aperture 240. An ice delivery chute 220 extends from the trough aperture 240. The ice delivery chute 220 channels the ice transported by the ice auger 210 to a bag.

A bag deliverer provides bags beneath the ice delivery chute 220. The bag deliverer includes a roll 310 of bags mounted on a bag holder 320. The bag holder 320 is preferably mounted on rails 330 to allow the bag holder 320 to slide out of the bag deliverer to allow for easy restocking of the roll 310 of bags, or when different sized bags of ice are desired to be produced. The roll 310 of bags comprises a plurality of preformed connected bags wound around a roll. Various sizes of bags may be wound on the roll; preferably, bags sufficient to hold 5, 10, or 20 pounds of ice, or, indeed, any pound or liter sized bags.

Figure 7:
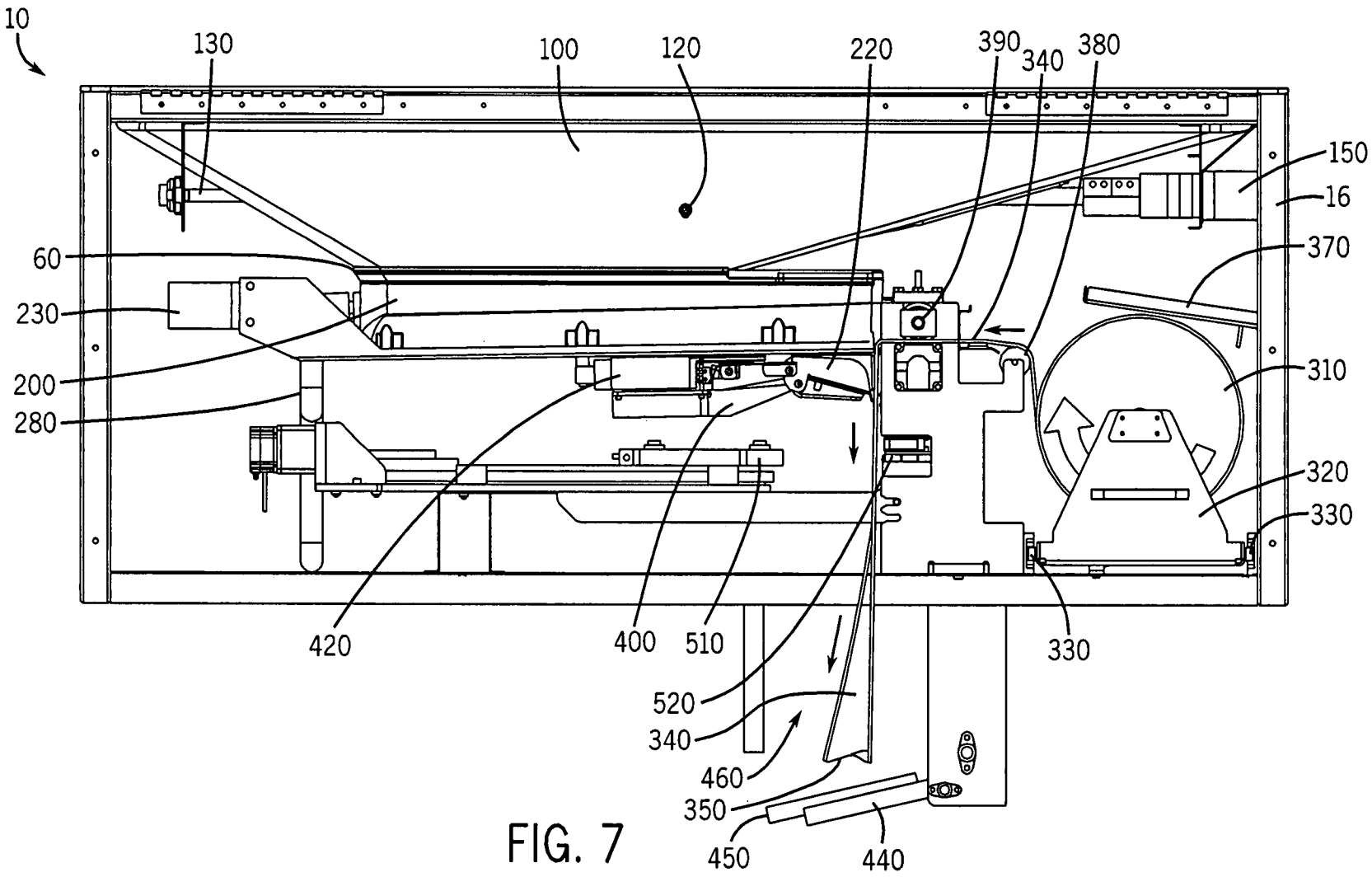
FIG. 7 is a side elevational view of the ice bagger of FIG. 1, with a roll of bags threaded through the ice bagger.

Referring now to FIG. 7, a side elevational view of the ice bagger 10 of FIG. 1 is seen, with the roll 310 of bags 340 threaded through the ice bagger 300. In one embodiment, the bags 340 have a pre-sealed bottom 350 and an unsealed top 360 (seen in FIG. 8). The bags 340 are connected end-to-end to form a substantially continuous roll. The bags 340 are configured in the roll 310 of bags 340 such that the pre-sealed bottom 350 leads when a bag 340 is rolled out of the roll 310 of bags 340, followed by the unsealed top 360 of the bag, followed by the pre-sealed bottom 350 of the next bag, etc.

The manner in which the bags 340 are connected may be of any conventional type, in that the particular manner in which the bags are connected is not an essential part of the present invention. Generally, the bags 340 may be perforated such that a portion of the unsealed top 360 of the bag is removably connected to the sealed bottom 350 of the second bag.

A bag tension bar 370 provides tension to the roll 310 of bags 340. The bag tension bar 370 is located beside the roll 310 of bags 340 and is joined at one end to a wall of the insulated enclosure 16. When the ice bagger 10 is activated to make ice, the tension bar 370 provides tension by applying downward pressure to the top of the roll 310 of bags 340. This pressure helps keep the bags 340 in the roll 310 of bags 340 generally centered and helps keep the bags in the roll 310 of bags 340 from becoming loose or bunching. In one embodiment, the weight of the bag tension bar 370 provides the tension to the roll 310 of bags 340. (In FIGS. 4 and 5, the tension bar 370 is depicted in the non-engaged position when the roll 310 of bags 340 is being installed.)

A plurality of bag rollers 380 transport bags from the roll 310 of bags 340 to a location beneath the ice delivery chute 220. The plurality of bag rollers 380 is best seen in FIG. 5. The bag rollers 380 can be driven by a roller motor 390 coupled to the bag rollers 380. The roller motor 390 is activated when a request to make additional inventory of bags of ice is made.

As a result, the bags 340 are pulled and advanced from the roll 310 of bags 340, travel between the bag rollers 380, and then under the ice delivery chute 220. A bag 340 is separated from the next bag after ice is deposited into the bag 340. The bag deliverer grasps the lower and upper bags 340 and removes the lower bag 340 from the upper bag along the perforation.

The unsealed top 360 of a first bag is at least partially disposed in a blower channel 400. A hatch 440 is positioned beneath the ice delivery chute 220, upon which the sealed bottom 350 of a bag rests while the bag is being filled with ice. The ice delivery chute 220 and the hatch 440 define a bag filling area 460, such that, a bag 340 is present in the bag filling area 460, the bag 340 is positioned to be filled.

Figure 8:
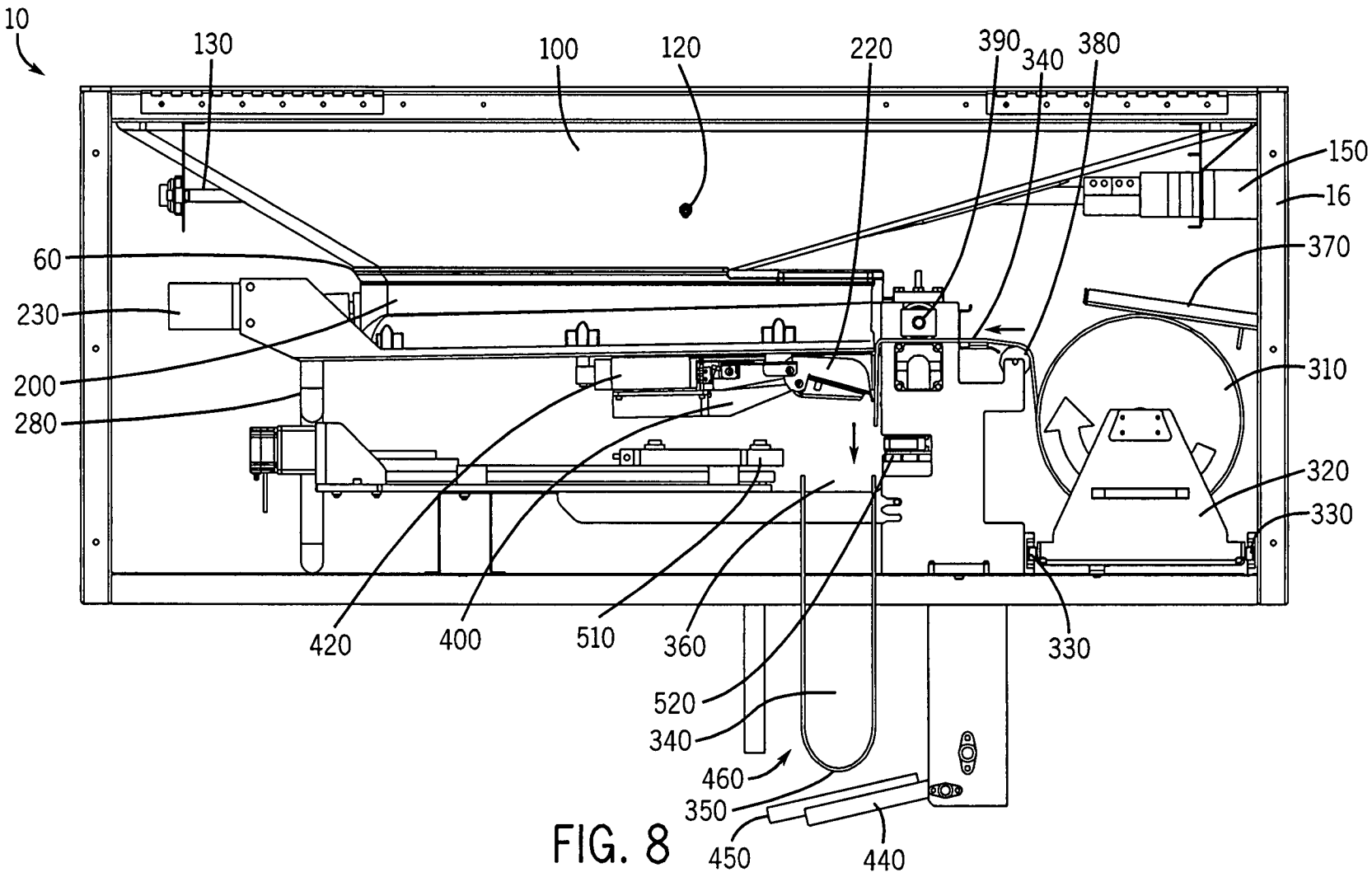
FIG. 8 is also a side elevational view of the ice bagger of FIG. 1, with a separated and open bag positioned to receive ice.

A blower 420 is positioned at the opposing end of the blower channel 400 to help open the unsealed top 360 of the bag 340 prior to ice being deposited in the bag 340. The blower 420 opens the bag 340 by channeling a stream of air through the blower channel 400 to the inside surface near the top 360 of the bag 340. FIG. 8 depicts the approximate position of the bag 340 under the ice delivery chute 220 after the bag 340 has been separated and blown open. As seen, the unsealed top 360 of the bag 340 is positioned beneath the ice delivery chute 220.

The ice is transported by the ice auger 210 from beneath the ice hopper 100 through the ice hopper aperture 60 to the ice delivery chute 220. The ice falls from the ice delivery chute 220 to the bag 340 by gravity. A scale 450 is positioned on the hatch 440. The scale 450 weighs the ice deposited into the bag 340. When the weight of the ice deposited into the bag 340 reaches a predetermined level, a signal is transmitted to the ice auger 210 to stop transporting ice. The bag 340 is then sealed by a sealer. The sealer includes a heat seal bar 510 and a heat seal element 520. The heat seal bar 510 presses the top 360 of a bag 340 against the seal element 520 to seal the bag 340. In the embodiment where the roll 310 of bags 340 do not have a pre-sealed bottom, the heat seal bar 510 similarly presses the bottom of a bag 340 against the seal element 520 to seal the bottom of the bag 340 prior to the bag 340 being filled. After the top 360 of the bag 340 has been sealed by the sealer 510, the hatch 440 opens and the bag of ice 340 is deposited in a bag depository 30. The hatch 440 is then repositioned to define a subsequent bag filling area 460 for filling a subsequent bag.

As previously introduced, the ice bagger 10 can be automated and/or computer controlled by a microprocessor in communication with a memory. A trigger graphic can be printed on the bags to communicate to sensors in the bag delivery system. Sensors and/or other means detect that a bag is appropriately position and ready to receive ice.

Figure 9B:
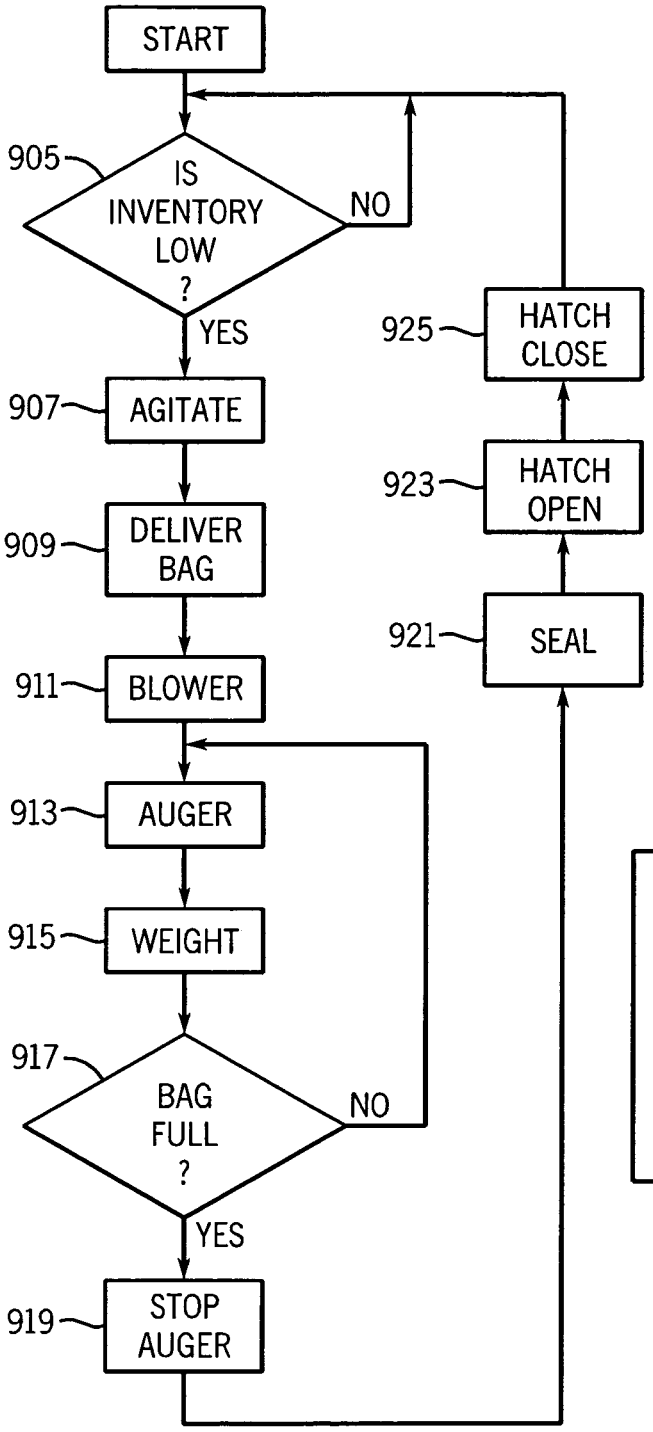
FIG. 9 is a flow chart of an example ice bagging process in accordance with the principles of the present invention.
Figure 9A:
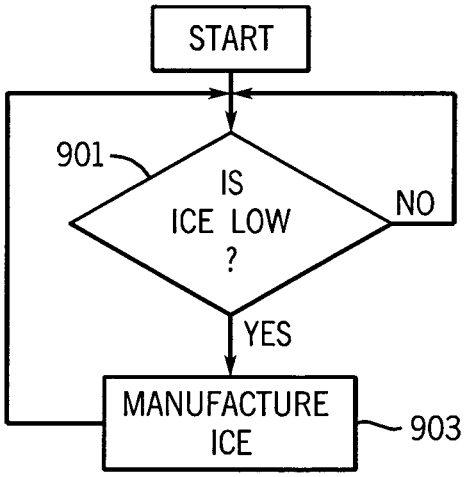

Referring now to FIG. 9, a method of operating the ice bagger 10 is described. Initially with respect to FIG. 9*a*, as previously detailed the ice hopper 100 includes at least one sensor 120 to measure the level of ice in the ice hopper 100. A query is made as to whether the level of ice in the hopper 100 is low (901). If the level of ice in the ice hopper 100 is low, then a signal is sent to the ice manufacturer 12 to manufacture more ice (903).

Referring to FIG. 9*b*, the level of inventory in the bag depository 14 likewise is monitored by a sensor. A query is made as to whether the level of inventory in the bag depository 14 is low (905). If the inventory of ice in the bag depository 14 is low, then the ice bagging process is initiated to make more bags of ice. When the ice bagging process is initiated to make more bags of ice, the ice agitator 130 disposed in the ice hopper 100 is activated (907) such that ice in the ice hopper 100 is stirred and churned to prevent bridging of ice and to break down pieces that have bridged together. The bag deliverer is activated (909) such that a bag is supplied to the bag filling area 460. The unsealed top 360 of the separated bag is at least partially disposed in the blower channel 400. The blower 420 is activated (911) such that the unsealed top 360 of the bag is blown open by the blower 420.

Ice is received from the ice hopper 100 through the ice hopper aperture 60 into the ice trough 200 positioned beneath the ice hopper 100. The ice auger 210 is activated (913) such that ice in the ice trough 100 is transported in a substantially horizontal direction to the ice delivery chute 220. Ice is deposited into the waiting bag via gravity. The scale 450 on the hatch 440 weighs the ice being deposited into the bag (915). If the scale 450 records the predetermined weight of ice in the bag has been achieved (917), then the ice auger 210 stops transporting ice (919). The bag sealer seals the bag (921), the hatch 440 is opened (923), and the sealed bag of ice is deposited into the bag depository 14. The hatch 440 is then repositioned to define a subsequent bag filling area 460 (925). If the inventory of ice in the bag depository 14 remains low, then the process is repeated until the inventory has been replenished.

In one embodiment, the microprocessor further transfers information with respect to the production of ice bags to memory. The microprocessor can provide information on features, functions, and details relating to the operation of the system. The microprocessor can continuously monitor and report/communicate system diagnostics and performance A method of communication can be provided (i.e. lights, messages, etc.) to store employees or others that bags need to be filled, ice in cooler needs to be repositioned, bags are empty, cooler is full, no ice made in x days, etc. (i.e. basic attendance of the device to continue regular operation of making and maximizing ice production), as well as for system errors or need for routine service maintenance. Sales and use data can be monitored and reported for billing/inventory control.

Such information can be made available on a network such as for example the Internet, and remote users may monitor the operation of the ice bagger. In addition, remote user interfaces can be provided to enable the remote user to be in two-way communication with the microprocessor. The remote user interfaces may include a personal computer, personal digital assistant, a cellular telephone, other type of computing devices and/or any combination thereof.

It should be understood that various changes and modifications referred to in the embodiment described herein would be apparent to those skilled in the art. Such changes and modifications can be made without departing from the spirit and scope of the present invention and without demising its attendant advantages. It is therefore intended that such changes and modifications be covered by the appended claims.

What is claimed is:

1. An ice bagger comprising:

a generally funnel-shaped ice hopper for receiving ice from an ice manufacturer, the ice hopper defining an ice hopper aperture thereunder;

an ice trough operably positioned beneath the ice hopper aperture to receive ice from the ice hopper, the ice hopper aperture and the ice trough being substantially co-extensive, the ice trough defining a bottom surface that is slightly inclined towards a trough aperture such that water that has accumulated in the ice trough drains away from the trough aperture;

a channel extending from an end of the ice trough opposite the trough aperture to an outside surface of the ice bagger, the channel configured to channel accumulated water away from the ice trough;

an ice auger housed inside the ice trough, the ice hopper aperture, the ice trough, and the ice auger being substantially co-extensive, the ice auger in driving connection with a motor, the ice auger adapted to transport ice along the ice trough towards the trough aperture, the ice auger transporting the ice upwardly at an incline sufficient to cause water resulting from melted ice to drain away from the trough aperture;

an ice agitator comprising a bar extending along the length of the hopper, the bar adapted to rotate around an axis along the length of the hopper, the bar having a plurality of fingers positioned perpendicular to a longitudinal axis of the bar to provide horizontal agitation to stir and churn ice in the ice hopper to prevent ice from bridging;

an ice delivery chute positioned beneath the trough aperture;

a hatch positioned beneath the ice delivery chute, the hatch adapted to release a filled bag for storage, the ice delivery chute and the hatch defining a bag filling area such that, when bags are present in the bag filling area, the bags are positioned to be filled; and a scale positioned on the hatch, the scale positioned to weigh the ice being deposited in the bag to determine when a designated amount of ice has been deposited into the bag.

2. The ice bagger of claim 1, wherein the ice hopper further comprises at least one sensor that detects the level of ice in the ice hopper.

3. The ice bagger of claim 1, further comprising a bag deliverer to deliver bags to the bag filling area.

4. The ice bagger of claim 3, wherein the bag deliverer comprises a bag holder adapted to receive and store a roll of a plurality of preformed connected bags;

a plurality of bag rollers adapted to transport the then connected bags from the roll of bags in the bag filling area;

a bag tension bar to provide tension to the roll of bags to help prevent the stream of bags from displacing off the bag track; and sensors and guides used to position the bag for filling.

5. The ice bagger of claim 4, wherein the bag holder is mounted on two rails to allow the bag holder to slide out of the ice bagger for easy replacement of a roll of bags.

6. The ice bagger of claim 1, further comprising a blower positioned with respect to the bag filling area to open the mouth of a bag prior to ice being deposited in the bag.

7. The ice bagger of claim 1, further comprising a sealer that seals the bag when the bag is full.

8. The ice bagger of claim 1, wherein the ice bagger is controlled by a microprocessor.

9. The ice bagger of claim 7, further wherein the sealer comprises a heat seal bar and a heat seal element.

10. The ice bagger of claim 1 wherein the bar extends horizontally along the length of the hopper, the bar adapted to rotate around a horizontal axis along the length of the hopper.

* * * * *